United States Patent [19]

Lehnhoff

[11] 4,014,573

[45] Mar. 29, 1977

[54] THUMBTURN AND ASSEMBLY AND METHOD OF PROVIDING A THUMBTURN

[75] Inventor: Hans F. Lehnhoff, Moraga, Calif.

[73] Assignee: Schlage Lock Company, San Francisco, Calif.

[22] Filed: Nov. 7, 1975

[21] Appl. No.: 629,881

[52] U.S. Cl. ..... 292/347

[51] Int. Cl.[2] ..... E05B 1/00

[58] Field of Search ..... 292/336.3, 347, 348, 292/356, 357

[56] References Cited

UNITED STATES PATENTS

| | | | |
|---|---|---|---|
| 2,454,927 | 11/1948 | Kalwo | 292/347 |
| 2,538,647 | 1/1951 | Lickteig | 292/357 X |
| 2,811,384 | 10/1957 | Schmid | 292/357 |

FOREIGN PATENTS OR APPLICATIONS

| | | | |
|---|---|---|---|
| 260,102 | 10/1926 | United Kingdom | 292/347 |

*Primary Examiner*—James C. Mitchell
*Attorney, Agent, or Firm*—Lothrop & West

[57] ABSTRACT

A thumbturn assembly for use with a door lock has a rose body having a face wall and adapted to be secured to a door panel. The rose body has a central hub concentric with an axis and has a bearing ring merging with the face wall and the hub and projecting from the face wall. A thumbturn has individual side walls connected by end walls and a front wall. A pair of semi-cylindrical journal walls extend from the side walls through the hub symmetrically with the axis. The journal walls merge with thrust walls merging with the side walls and facing the bearing ring. The ends of the journal walls extend through openings in the end wall of a cap having a drum wall concentric with the axis. The ends of the journal walls are bent to provide lugs urging the cap toward the hub and urging the thrust walls toward the bearing ring. The cap end wall also has an opening for a driver bar.

The thumbturn is made by forming a somewhat yieldable planar sheet into an approximately elliptical central portion having a pair of tabs extending from the opposite sides of the central portion. The central portion is then drawn into a cup, leaving the tabs in their original planar position. The tabs are then curved into semi-cylindrical shape facing in the same direction. Finally the tabs are moved into a position concentric with an axis normal to the original plane. Preferably junctures of narrower width than the tabs are disposed between the tabs and the central portion.

7 Claims, 22 Drawing Figures

FIG. 2
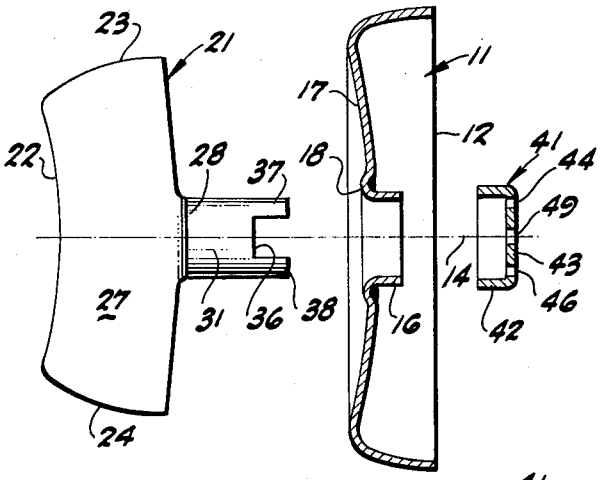
FIG. 3
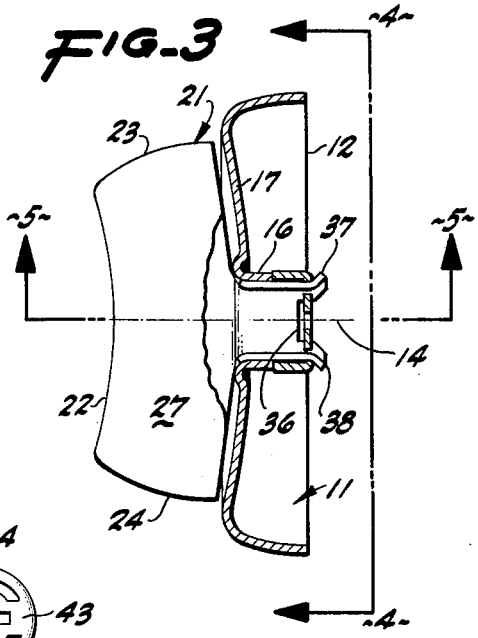
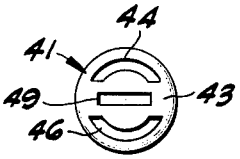
FIG. 6
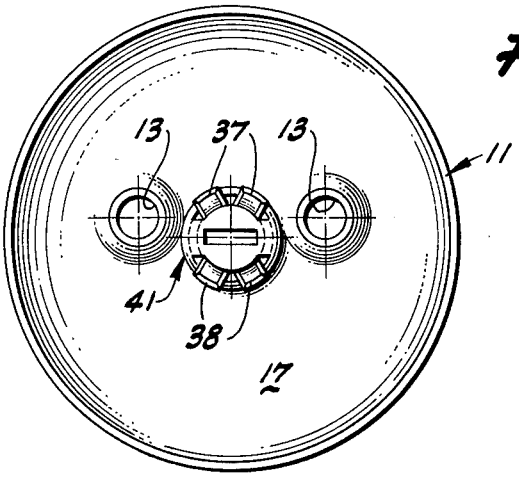
FIG. 4
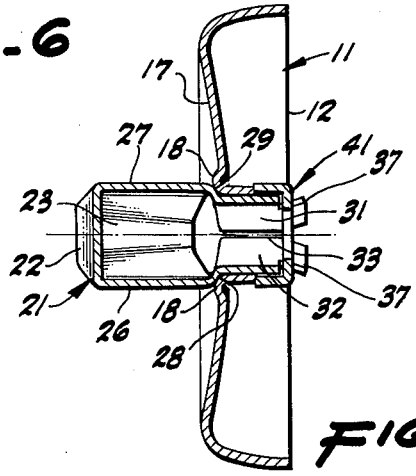
FIG. 5
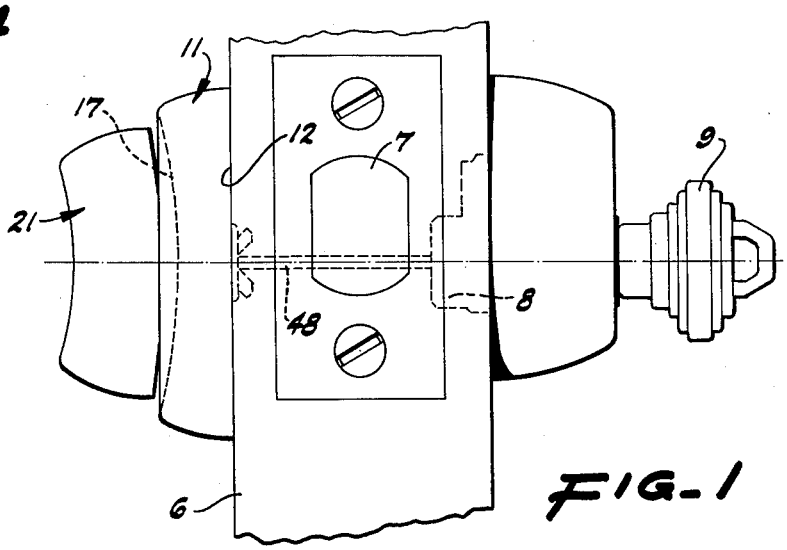
FIG. 1

THUMBTURN AND ASSEMBLY AND METHOD OF PROVIDING A THUMBTURN

Lock mechanisms for doors normally have some sort of operating handle either in the form of a knob or of a lever or of a thumbturn. The thumbturn is rotated by the thumb and finger of a user disposed on opposite sides of a central bar portion of the thumbturn. The thumbturn is mounted for rotation in a plate or rose body secured to the door panel. A driver bar connects the thumbturn with the lock mechanism to actuate a latch or bolt. There have been some difficulties in providing a thumbturn suitably and securely mounted for rotation, that can satisfactorily transmit some axial movement upon occasion, and that avoids rattling and looseness and that can economically be manufactured and easily and simply connected and installed.

It is therefore an object of the invention to provide a thumbturn assembly, including a rose plate, that has good axial and radial bearing support during a protracted life and that tends to remain relatively tight and snug despite extensive operation, so avoiding looseness and rattling.

Another object of the invention is to provide a thumbturn assembly in which the thumbturn itself is easily and conveniently manufactured and that maintains a good bearing relationship with its rose plate over an extended life.

A further object of the invention is to provide a thumbturn assembly that can be utilized with driver bars and locks of recognized construction.

A further object of the invention is to provide an improved, economical and satisfactory thumbturn assembly and method of providing a thumbturn.

Other objects, together with the foregoing, are attained in the embodiment of the invention described in the accompanying description and illustrated in the accompanying drawings, in which:

FIG. 1 is an end elevation, with portions broken away, of a door panel on which the thumbturn assembly of the invention is mounted in connection with a regular form of bolt and key bolt actuator;

FIG. 2 is a cross-section through a disassembled rose plate and cap showing a thumbturn in side elevation and in exploded position;

FIG. 3 is a view comparable to FIG. 2 but showing the parts in assembled position with a portion of the thumbturn itself being broken away to disclose a cross-section on an axial plane;

FIG. 4 is an end elevation of the thumbturn assembly, the plane of section being indicated by the line 4—4 of FIG. 3;

FIG. 5 is a view somewhat comparable to FIG. 3 but showing the device in cross-section on a plane at right angles to the plane of FIG. 3, as indicated by the section line 5—5 of FIG. 3;

FIG. 6 is a detail showing the cap in end elevation; and

Figures 7, 8, 9, 10, 11, 12, 13, 14, 15, 16, 17, 18, 19, 20, 21, 22:
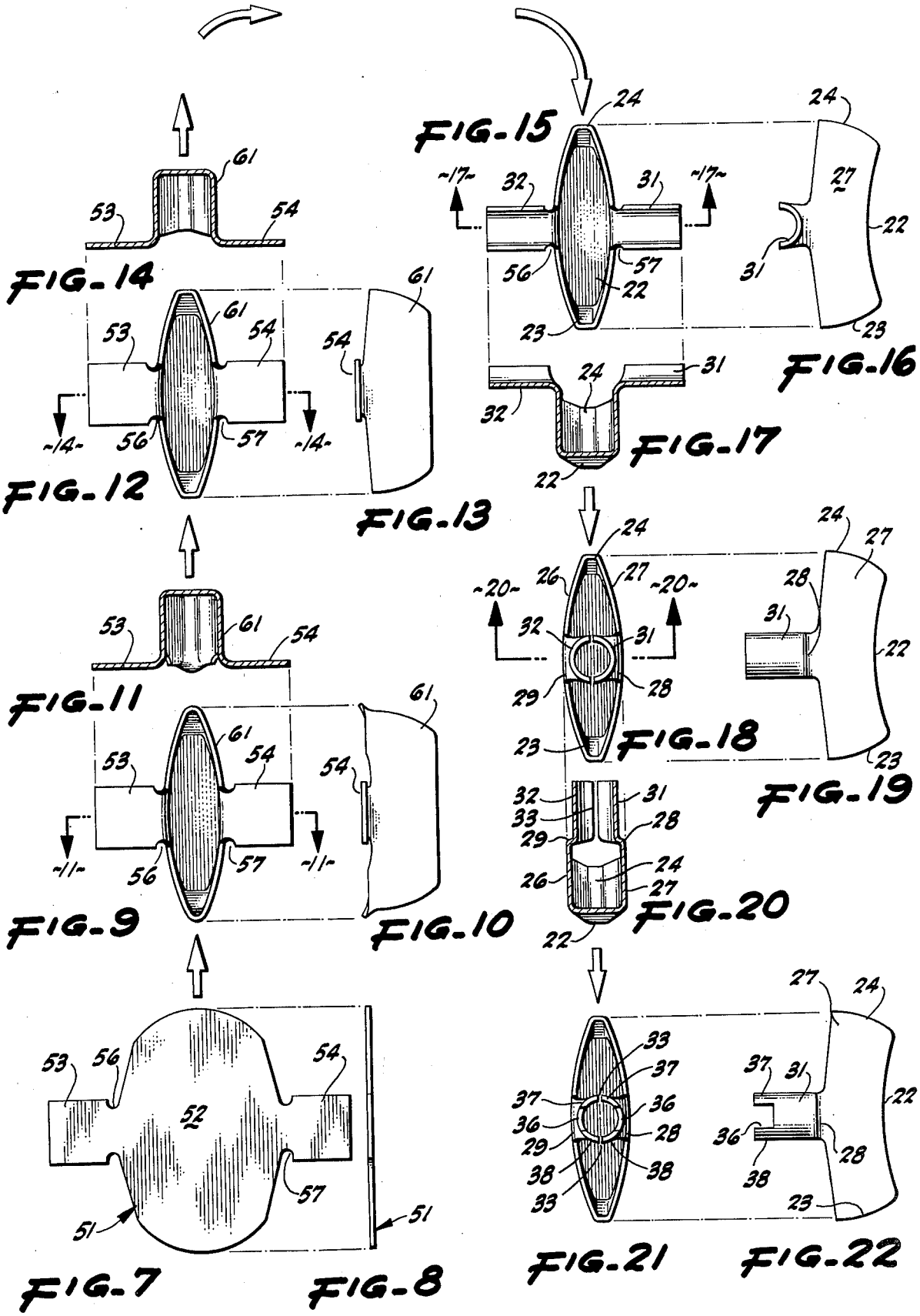

FIGS. 7 to 22 have to do with the method of forming the thumbturn, as follows:

FIG. 7 is a plan of a formed planar sheet;

FIG. 8 is an end elevation of the sheet of FIG. 7;

FIG. 9 is an end view of a partially formed thumbturn;

FIG. 10 is a side elevation of the structure shown in FIG. 9;

FIG. 11 is a cross-section, the plane of which is indicated by the line 11—11 of FIG. 9;

FIG. 12 is a view comparable to FIG. 9 but showing a different form of the central portion of the thumbturn;

FIG. 13 is a side elevation of the formed and trimmed device of FIG. 12;

FIG. 14 is a cross-section, the plane of which is indicated by the line 14—14 of FIG. 12;

FIG. 15 is a view comparable to FIG. 12 but showing a subsequent step with the tabs in semi-cylindrical form;

FIG. 16 is a side elevation of the structure of FIG. 15;

FIG. 17 is a cross-section, the plane of which is taken on the line 17—17 of FIG. 15;

FIG. 18 is an elevation comparable to FIG. 15 but showing the tabs moved into coaxial arrangement;

FIG. 19 is a side elevation of the device of FIG. 18;

FIG. 20 is a cross-section of the structure shown in FIG. 18, as indicated by the line 20—20 of FIG. 18;

FIG. 21 is an end elevation comparable to FIG. 18 but showing the thumbturn with a transverse slot therein; and FIG. 22 is a side elevation of the structure of FIG. 21.

In the usual, exemplary installation, the mechanism of the invention is installed in a door panel 6 of the customary kind mounted to swing with respect to a door frame, not shown, and being provided with a locking bolt 7 that can be projected and retracted by means of a key lock 8 actuated by a removable key 9. All of this is standard.

Particularly pursuant to this invention, there is also provided on the door panel 6 a rose body 11 preferably formed of a single sheet of metal or comparable somewhat resilient and yieldable material of uniform thickness. The body is configured substantially into the shape of a circular cup having a planar face 12 or edge designed to abut the door panel and normally held in position by fastenings, not shown, going through appropriate apertures 13. The rose body is conveniently symmetrical about an axis 14 normal to the door panel and is provided with a generally circular cylindrical hub 16 extending toward the edge 12 from a face wall 17 of the rose body. The face wall may be flat or concave or otherwise appropriately contoured for artistic purposes and despite its curvature is substantially normal to the axis 14. The wall 17 merges with the hub 16 by means of an intervening bearing ring 18 constituted by an annular portion of the face wall 17 concentric with the axis 14 and projecting forwardly or away from the edge 12. The ring provides a relief or ridge outstanding from the wall 17. Preferably the rose body is installed on the door panel 6 with the axis 14 substantially in common with the axis of the key lock 8.

Designed to cooperate with the rose body is a thumbturn 21 formed from a sheet of somewhat yieldable material of uniform thickness like that of the rose body. The thumbturn is configured to provide a front wall 22, a pair of connected end walls 23 and 24 and a pair of spaced apart individual side walls 26 and 27 (see FIG. 5). The configuration of the end walls 23 and 24, of the front wall 22 and of the side walls is arranged not only for an artistic and pleasing appearance but also for ready engagement between the thumb and forefinger of a user. The side walls 26 and 27 lie on opposite sides of the axis 14 in a generally diametrical fashion. Each of the walls 26 and 27 is especially formed to merge with one of a pair of arcuate thrust walls 28 and 29. These portions depart from the adjacent side walls and provide end surfaces facing the end surface of the annular bearing ring 18. The transversely extending bearing walls 28 and 29 are not completely circular, but are of sufficient extent to afford an ample axial bearing.

Each of the bearing portions merges with a related one of a pair of individual journal walls 31 and 32 facing each other but each being separate from its mate. The walls 31 and 32 are divided by a pair of intervening slots 33, so that the journal walls do not quite touch. Both walls are semi-cylindrical, being symmetrical about the axis 14 and considered together form an almost complete journal. Each of the bearing walls at its end is interrupted by a notch 36 leaving extended lugs 37 and 38.

At assembly, the thumbturn 21 is moved axially toward and into the rose body 11 so that the journal walls 31 and 32 reside within the hub 16 in a good rotary relationship therewith and with the thrust walls 28 and 29 facing the bearing ring 18. The lugs 37 and 38 initially extend straight past the end of the hub 16 to receive a cap 41. This is a metallic member including a drum wall 42 concentric with the axis 14 and an end wall 43 that is planar and has a pair of arcuate openings 44 and 46 therein of an extent to receive the lugs 37 and 38.

When the lugs 37 and 38 have been introduced through the openings 44 and 46, they are splayed or bent or moved in different radial directions into angles having substantial axial components. The thumbturn material is slightly yielding, so that the bent lugs are effective to urge the cap 41 axially until its end substantially abuts and serves as an axial positioner against the end of the hub 16. The bending of the lugs is also sufficient so that the thrust walls 28 and 29 are drawn into or very nearly into abutment with the bearing ring 18. The assembly can be made relatively tight or loose by the amount of initial bending or deformation of the lugs 37 and 38.

Once the initial deformation has been satisfactorily established, the parts tend to remain in initial condition. Partly this is because the journal walls, being separated by a channel 33, can move radially toward and away from each other in small amounts. The usual assembly is with sufficient deformation so that a snug rattle-free bearing results, although not so tight as to preclude ready rotation. As the mechanism wears during long use, the journal walls tend to separate more from each other, widening the channel 33 slightly and maintaining a good radial bearing relationship. Similarly, the thrust walls tend to set up snugly against the bearing ring, but not so tightly as to preclude ready rotation. As wear occurs over a period of operation, the resilient, angled lugs 37 and 38 tend to draw the parts axially together despite wear. There is maintained a good axial bearing relationship, rattle-free despite endwise pulling on the thumbturn.

When the rose and thumbturn mechanism are mounted on the door panel 6, a driver bar 48 (FIG. 1) is seated in an opening 49 extending diametrically of the cap 41. The driver bar is of customary construction and connects to the bolt 7 and the lock mechanism 8 in the usual way. After the assembly is mounted on the door panel, as indicated, the thumbturn 21 can be rotated to project and retract the bolt 7. There is in practice very little rattle or play in the mechanism, even after a very large number of operations, the materials and construction tending to maintain the parts in light frictional abutment both axially and radially.

The thumbturn of the device is made particularly according to a special method, as illustrated FIGS. 7 to 22. In this method there is initially provided a planar sheet 51 of metal having some yieldability and resilience. The initially planar sheet is formed with an approximately elliptical central portion 52 from which extend tabs 53 and 54. These project from the centers of the opposite sides of the central portion of the initial sheet and are generally rectangular in themselves. The tabs 53 and 54 are connected to the central sheet through junctures 56 and 57 having a width reduced from the width of the tabs 53 and 54.

From the form shown in FIG. 7 the sheet is reshaped as shown in FIG. 9 by drawing to provide a central generally elliptical cup 61 deformed from the central portion 52 but with the junctures 56 and 57 being bent to leave the tabs 53 and 54 remaining in their initial plane. The next operation, as shown in FIGS. 12 and 13, is to trim the cup 61 into the edge and end wall aspect as shown in FIG. 13. Then the trimmed cup with its attached, extending tabs is advanced to an operation in which the cup itself is provided with a curved front wall 22 as shown in FIG. 17. More particularly, the still extending tabs 53 and 54 are configured into the semi-cylindrical walls 31 and 32.

In the next operation, the journal walls 31 and 32 are bodily moved toward each other, accompanied by flat deformation of the junctures 56 and 57, until the curved walls 31 and 32 are concentric with the axis of the device. This positions the thrust walls 28 and 29 to form a thrust bearing while the journal walls 31 and 32 are brought into position forming a substantially circular journal having the slots 33 therein. Finally, the device of FIG. 18 is shaped to provide the diametrical end notches 36 defining the lugs 37 and 38. From this series of operations there results a thumbturn as shown in FIG. 2, for example.

What is claimed is:

1. A thumbturn and assembly comprising a rose body including a hub concentric with an axis, including a face wall approximately normal to said axis, and including a bearing ring merging with said face wall and said hub and projecting axially from said face wall; a thumbturn including individual side walls disposed on opposite sides of said axis, including a pair of separate journal walls concentric with said axis, and including thrust walls merging with said side walls and said journal walls and facing said bearing ring; and means for transmitting force between said journal walls and said hub in a direction to urge said thrust walls toward said bearing ring.

2. A device as in claim 1 in which said journal walls are radially yieldable.

3. A device as in claim 1 including a cap having a drum wall concentric with said axis and adapted substantially to abut said hub.

4. A device as in claim 3 in which said cap includes an end wall normal to said axis and having an opening therein, and a lug on one of said journal walls passing through said opening and overlying said end wall.

5. A device as in claim 4 in which said lug is axially yieldable.

6. A device as in claim 4 including an additional lug passing through an opening in said end wall and in which said lug and said additional lug extend in different radial directions.

7. A device as in claim 1 including a face wall and end walls interconnecting said side walls; said face wall, end walls, side walls, thrust walls and journal walls all being of substantially the same thickness.

* * * * *